US007503985B2

(12) United States Patent
Ichitani et al.

(10) Patent No.: US 7,503,985 B2
(45) Date of Patent: Mar. 17, 2009

(54) QUENCHING METHOD

(75) Inventors: Katsumi Ichitani, Ichihara (JP); Makoto Takeishi, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 10/310,050

(22) Filed: Dec. 5, 2002

(65) Prior Publication Data

US 2003/0136484 A1 Jul. 24, 2003

(30) Foreign Application Priority Data

Jan. 22, 2002 (JP) ..... 2002-012670

(51) Int. Cl.
*C21D 1/58* (2006.01)
*C21D 1/60* (2006.01)

(52) U.S. Cl. ..... 148/637; 148/638; 148/713

(58) Field of Classification Search ..... 148/636, 148/637, 638

See application file for complete search history.

(56) References Cited

U.S. PATENT DOCUMENTS

| | | | | | |
|---|---|---|---|---|---|
| 3,939,016 | A | * | 2/1976 | Tokuue et al. | 148/28 |
| 4,066,430 | A | * | 1/1978 | Franz | 65/116 |
| 4,087,290 | A | * | 5/1978 | Kopietz et al. | 148/18 |
| 4,090,891 | A | * | 5/1978 | Mitamura et al. | 148/28 |
| 4,213,828 | A | * | 7/1980 | Calderon | 201/39 |
| 4,251,292 | A | * | 2/1981 | Foreman et al. | 148/508 |
| 4,404,044 | A | * | 9/1983 | Warchol | 148/18 |
| 4,528,044 | A | * | 7/1985 | Warchol | 148/638 |
| 4,584,033 | A | * | 4/1986 | Harding et al. | 148/638 |
| 4,596,612 | A | * | 6/1986 | Fradique | 148/638 |
| 4,803,037 | A | * | 2/1989 | McBain et al. | 266/78 |
| 4,848,752 | A | * | 7/1989 | Braud et al. | 266/114 |
| 4,969,959 | A | * | 11/1990 | Marr et al. | 148/703 |
| 5,122,336 | A | * | 6/1992 | Roux et al. | 420/108 |
| 5,422,024 | A | * | 6/1995 | Vickerman et al. | 508/506 |
| 5,490,886 | A | * | 2/1996 | Placek | 148/637 |
| 5,518,557 | A | * | 5/1996 | Jones et al. | 148/511 |
| 6,451,137 | B1 | * | 9/2002 | Pelissier | 148/660 |

FOREIGN PATENT DOCUMENTS

| | | | |
|---|---|---|---|
| DE | 2608850 | * | 9/1977 |
| EP | 0 505 239 A1 | | 9/1992 |
| FR | EP 0 505 239 A1 | | 3/1991 |
| GB | 2197347 A | * | 5/1988 |
| JP | 61-079716 | * | 4/1986 |
| JP | 63-183121 A | * | 7/1988 |
| JP | 63183121 | * | 7/1988 |
| JP | 05-17817 | * | 1/1993 |
| JP | 5-45058 | | 6/1993 |
| JP | 08060234 A | * | 3/1996 |
| JP | 11-269535 | | 10/1999 |
| JP | 2001-316722 | | 11/2001 |

OTHER PUBLICATIONS

Derwent-ACC-No. 1992-318113, Sieve palte for selectively separeating ground material made from steel which can be heat treateted to give final hardness above 400 HB, 2 pages, Sep. 23, 1992.*

Metals Handbook, 8th Ed., vol. 1, "Properties and Selection of Metals", pp. 94-95, 1961.*

Heat Treatment of Steel, p. 166, 1993, (with attached English Translation).

* cited by examiner

*Primary Examiner*—George Wyszomierski
(74) *Attorney, Agent, or Firm*—Oblon, Spivak, McClelland, Maier & Neustadt, P.C.

(57) ABSTRACT

Provided is a quenching method capable of producing quenched articles having little distortion and having a desired hardness. The quenching method with a coolant is specifically so controlled that the surface of the quenching bath is kept under pressure all the time throughout the step of cooling the articles being processed therein.

14 Claims, No Drawings

QUENCHING METHOD

BACKGROUND OF THE INVENTION

1. Field of the Invention

The present invention relates to a quenching method, more precisely, to a quenching method improved in point of reducing quenching distortion.

2. Description of the Related Art

In the field of automobile industry, quenching distortion of gears results in a gear-to-gear meshing error, therefore causing noises and damage to gear teeth. In the field of bearings, their quenching distortion results in increasing the grinding allowance in the subsequent process, therefore causing the productivity reduction.

Heretofore, an oily agent well workable even at high oil temperatures, so-called hot oil (having a kinematic viscosity at 100° C. of from 10 to 30 $mm^2$/sec or so) is used for reducing quenching distortion. Hot oil of the type is highly effective for reducing quenching distortion, but is often problematic in that the articles quenched therein could not be cooled rapidly and their hardness is not good. As a result, the teeth of the quenched articles may be damaged or broken and the fatigue life thereof is not long.

On the other hand, when cold oil (having a kinematic viscosity at 100° C. of at most 6 $mm^2$/sec or so) is used, the articles quenched therein may have a high hardness but are problematic in that their distortion increases.

As in the above, the hardness of quenched articles and the quenching distortion thereof are in the trade-off, and cold oil is used when the hardness of quenched articles is considered important but hot oil is used when the reduction in quenching distortion is considered important.

Recently, however, for obtaining quenched articles that are distorted little and have a desired hardness, some methods have been proposed in which the quenching bath used is kept pressurized in a certain period of time during the cooling step. For example, JP-A-61-79716 discloses a method in which the quenching bath used is kept under atmospheric pressure until the quenched articles reach around the Ms point thereof and then it is pressurized at around the Ms point to thereby control the boiling point of the quenching oil therein. This is for retarding the cooling rate in the bath. JP-A-4-28818 discloses a method in which the quenching bath used is kept under reduced pressure up to around the Ms point thereof and then pressurized at around the Ms point to thereby control the boiling point of the quenching oil therein. This is also for retarding the cooling rate in the bath. JP-A-8-60234 discloses a method in which the quenching bath used is kept under pressure until it reaches the characteristic temperature thereof, and, after it has become lower than the characteristic temperature, its pressure is gradually lowered to atmospheric pressure or to around atmospheric pressure. In any of these methods, the quenched articles could have the desired hardness, but there is still room for improvement in these methods in point of reducing the quenching distortion therein.

SUMMARY OF THE INVENTION

The present invention has been made from the viewpoint as above, and its object is to provide a quenching method capable of producing quenched articles having little distortion and having a desired hardness.

We, the present inventors have assiduously studied and, surprisingly as a result, have found that, when the surface of the quenching bath is kept under pressure all the time throughout the step of cooling the articles being processed therein, then the above-mentioned object can be effectively attained. On the basis of this finding, we have completed the present invention.

Specifically, the invention is summarized as follows:

1. A quenching method using a coolant, in which the surface of the quenching bath is kept under pressure all the time throughout the step of cooling the articles being processed therein.
2. The quenching method of above 1, wherein the coolant is a quenching oil having a kinematic viscosity at 100° C. of at most 20 $mm^2$/sec.
3. The quenching method of above 1, wherein the coolant is a water-soluble quenching liquid.
4. The quenching method of above 1, which is carried out while the coolant is stirred.

DETAILED DESCRIPTION OF THE INVENTION

The invention is described in detail hereinunder.

The invention is a quenching method using a coolant, in which the surface of the quenching bath is kept under pressure all the time throughout the step of cooling the articles being processed therein.

In the wording "all the time throughout the step of cooling the articles being processed", the cooling step includes three stages, vapor blanket stage, boiling stage and convection stage that are effected in that order, and the wording is meant to indicate that the articles are cooled all the time throughout the cooling step. The vapor blanket stage is the first stage of the cooling step with a coolant. In this stage, the vapor having been generated through contact of the high-temperature metal surface of the article being processed with the coolant surrounds the entire surface of the article, and the article is cooled only via the vapor blanket. In the next boiling stage, the coolant is brought into direct contact with the article after the vapor blanket has been broken, and the coolant vigorously boils around the article. In this stage, the latent heat for vaporization of the coolant around it cools the article, and the cooling rate is the greatest. In the last convection stage, the temperature of the coolant is lower than the boiling point thereof, and the coolant absorbs the heat of the article only through the convective flow of the coolant to elevate its temperature by itself. In this stage, therefore, the article is cooled only by the convection of the coolant there around.

The pressure to the quenching bath preferably falls between 100 and 980 kPa. If lower than 100 kPa, it is near to atmospheric pressure and will lose its effect; but if higher than 980 kPa, it is also unfavorable since the coolant ability will be low. The pressure may be kept the same or may not.

In the invention, the surface of the quenching bath is kept under pressure all the time through out the step of cooling the articles being processed. Its advantages are that the length of the vapor blanket (in terms of the number of characteristic seconds) is reduced in the vapor blanket stage, the width (in terms of the temperature width) in the boiling stage is reduced, and the convention-starting point in the convection stage increases. All these are favorable for reducing the quenching distortion of the quenched articles, or that is, the distortion of the quenched articles is reduced under the specific condition of the invention. However, in case where the coolant is a quenching oil, it may have some negative influence on the hardness of the quenched articles in the boiling stage and the convection stage. In that case, therefore, the articles to be processed are preferably thin articles, small-sized articles and those of well quenchable materials.

Preferably, the quenching oil for the coolant has a kinematic viscosity at 100° C. of at most 20 $mm^2$/sec, as it has no negative influence on the washability of the quenched articles in the post-treatment thereof.

On the other hand, in case where the coolant is a water-soluble quenching liquid, the pressure applied thereto is favorable for reducing the quenching distortion in all the stages of vapor blanket stage, boiling stage and convection stage, like to the quenching oil. Regarding the hardness thereof after quenched, if articles are quenched in a water-soluble quenching liquid for the coolant under atmospheric pressure, they will be too hard and will be often cracked, but if quenched therein under pressure, their hardness will be good. Therefore, the pressure to the water-soluble quenching liquid for the coolant is favorable for good hardness of the quenched articles. Accordingly, in the invention, a water-soluble quenching agent is especially favorable for the coolant for all articles.

More preferably in the invention, the coolant is stirred during the quenching process using it, since the articles thus processed therein can be uniformly quenched.

In the invention, the quenching bath to be used must be resistant to pressure, for which, therefore, preferred are commercially-available vacuum kilns or vacuum carburization kilns. Also preferred are closed kilns as the air tightness therein can be increased. For example, the pressure therein may be increased up to about 980 kPa when the kilns are equipped with a pipe for purging gas to be led thereinto.

In case where such a vacuum kiln or a vacuum carburization kiln is used for processing articles herein, the articles heated in vacuum therein are conveyed to the quenching bath that contains a coolant therein and then put thereinto to be quenched in the bath. In this step, the articles maybe transferred from the heating kiln to the quenching bath under reduced pressure, or alternatively, they may be once restored to atmospheric pressure and then transferred into the quenching bath. In any case, the upper side of the quenching bath is generally so controlled that the pressure thereto may vary from reduced pressure to atmospheric pressure. In the invention, the surface of the quenching bath is kept under pressure through pressure application thereto via a pressure-restoring gas line or the like connected to the bath, and the articles are quenched in the bath in that condition. In case where the time for pressure application to the bath is desired to be shortened, it is desirable that an accumulator or the like is fitted to the bath and the surface of the bath is pressurized within a short period of time.

The quenching oil for use in the invention is generally mineral oil. It includes, for example, distillate oil obtained through atmospheric pressure distillation of paraffin-base crude oil, intermediate-base crude oil or naphthene-base crude oil; distillate oil obtained through reduced pressure distillation of the residue from the atmospheric pressure distillation of such crude oil; and pure oil obtained by purifying the distillate oil in an ordinary manner, such as solvent-purified oil, hydrogenation-purified oil, dewaxed oil, clay-processed oil. Also usable herein is synthetic oil that includes, for example, poly-α-olefins (PAO), α-olefin copolymers, polybutenes, alkylbenzenes, polyol esters, dibasic acid esters, polyoxyalkylene glycols, polyoxyalkylene glycol esters, polyoxyalkylene glycol ethers, hindered esters, silicone oils, etc.

For the water-soluble quenching liquid for use herein, a water soluble polymer of, for example, polyalkylene glycols (PAG), polyvinyl alcohols (PVA), polyvinylpyrrolidones (PVP), sodium polyacrylates (SPA), sodium polyisobutylenemaleates (PMI) or polyethylene glycols (PEG) may be dissolved in water from 1 to 50% by mass, preferably from 5 to 30% by mass.

In addition to the above, the coolant for use in the invention may optionally contain any other additives of, for example, extreme pressure agents, detergent dispersants, antioxidants, defoaming agents and coolant improvers not interfering with the object of the invention.

EXAMPLES

The invention is described in more detail with reference to the following Examples, which, however, are not intended to restrict the scope of the invention.

Example 1

Using paraffin-base mineral oil having a kinematic viscosity at 100° C. of 18.6 $mm^2$/sec for quenching oil, a quenching test was carried out under the condition mentioned below. The physical properties of the thus-processed articles were measured according to the methods mentioned below. The test data are given in Table 1 below.

Quenching Test:

Shape of test pieces: Doughnuts shape thin plates of SCM420 having an outer diameter of 80 mmφ, an inner diameter of 40 mmφand a thickness of 0.8 mm were tested.

Quenching condition: The test pieces were uniformly heated at 850° C. for 1 hour, and then processed in the quenching oil at 120° C.

Pressure to the surface of the quenching bath: 343 kPa (increased pressure).

Measurement of Quenching Distortion:

Circularity: After quenched as in the above, the outer diameter of each plate was measured at 6 points with a micrometer, and the difference between the maximum value and the minimum value thus measured was obtained.

Measurement of Hardness:

The center hardness of each quenched plate was measured according to the Rockwell hardness test method of JIS Z 2245.

Measurement of Detergency:

A SPCC plate (cold-rolled steel plate of 60 mm (length)× 80 mm (width)×1.2 mm (thickness)) was dipped in the quenching oil used in examples or comparative examples, then taken out and left as such for 1 day to remove the oil. Next, this was washed with a 6% by mass of alkali detergent at 70° C. and at 300 rpm for 15 minutes.

Comparative Example 1

The same quenching test as in Example 1 was tried, in which, however, the pressure to the surface of the quenching bath was 98 kPa (atmospheric pressure). The test data are given in Table 1.

Example 2

The same quenching test as in Example 1 was tried, in which, however, the quenching oil used is paraffin-base crude oil having a kinematic viscosity at 100° C. of 31.5 $mm^2$/sec. The test data are given in Table 1.

TABLE 1

| | Example 1 | Comp. Ex. 1 | Example 2 |
|---|---|---|---|
| Circularity (μm) | 42 | 115 | 30 |
| Hardness (HRA) | 80 | 81 | 80 |
| Amount of Oil having adhered to the plate before washing (mg) | 66.0 | 66.2 | 91.3 |
| Amount of Oil having still adhered to the plate after washing (mg) | 26.6 | 26.8 | 42.0 |

Example 3

Using a water-soluble quenching liquid that had been prepared by dissolving 20% by mass of Dn. Plastic Quench FQ (by Idemitsu Kosan) in water, a quenching test was carried out under the condition mentioned below. The physical properties of the thus-processed articles were measured according to the methods mentioned below. The test data are given in Table 2 below.

Quenching Test:

Shape of test pieces: Cylinder shape bearing rings of SUJ2 having an outer diameter of 80 mmϕ, a height of 17 mm and a thickness of 5 mm were tested.

Quenching condition: The test pieces were uniformly heated at 850° C. for 1 hour, and then processed in the quenching oil at 40° C.

Pressure to the surface of the quenching bath: 343 kPa (increased pressure).

Measurement of Quenching Distortion:

Oval distortion: After quenched as in the above, the outer diameter of each ring was measured with a circularity meter, and the difference between the maximum value and the minimum value thus measured was obtained. If unevenly cooled in the water-soluble quenching liquid, the oval distortion of the rings increases.

Measurement of Hardness:

The center hardness of each quenched ring was measured according to the Rockwell hardness test method of JIS Z 2245.

Comparative Example 2

The same quenching test as in Example 3was tried, in which, however, the pressure to the surface of the quenching bath was 98 kPa (atmospheric pressure) The test data are given in Table 2.

TABLE 2

| | Example 3 | Comp. Ex. 2 |
|---|---|---|
| Oval Distortion (μm) | 100 | 125 |
| Hardness (HRC) | 64.5 | 65.0 |

As described in detail hereinabove with reference to its embodiments, the quenching method of the invention gives quenched articles having little distortion and having high hardness.

What is claimed is:

1. A method for quenching an article, comprising cooling the article in a quenching bath comprising a coolant, thereby quenching the article, wherein the surface of the coolant in the quenching bath is kept under continuous pressure throughout the cooling of the article, wherein the pressure ranges from 343 to 980 kPa, and wherein the coolant is a quenching oil or a water-soluble quenching oil having a kinematic viscosity at 100 ° C. of at most 20 $mm^2/s$.

2. The quenching method as claimed in claim 1, wherein the quenching oil is a water-soluble quenching oil, and wherein the water-soluble quenching oil comprises at least one polymer selected from the group consisting of polyvinyl alcohols, polyvinylpyrrolidones, sodium polyacrylates, sodium polyisobutylenemaleates and polyethylene glycols in an amount of from 1 to 50% by mass.

3. The method of claim 2, wherein the water soluble quenching oil comprises polyvinyl alcohols.

4. The method of claim 2, wherein the water soluble quenching oil comprises polyvinylpyrrolidones.

5. The method of claim 2, wherein the water soluble quenching oil comprises sodium polyacrylates.

6. The method of claim 2, wherein the water soluble quenching oil comprises sodium polyisobutylenemaleates.

7. The method of claim 2, wherein the water soluble quenching oil comprises polyethylene glycols.

8. The quenching method as claimed in claim 1, wherein the coolant comprises the water-soluble quenching oil, and wherein the water-soluble quenching oil comprises at least one polymer selected from the group consisting of polyvinyl alcohols, polyvinylpyrrolidones, sodium polyacrylates, sodium polyisobutylenemaleates and polyethylene glycols in an amount of from 5 to 30% by mass.

9. The method of claim 8, wherein the water soluble quenching oil comprises polyvinyl alcohols.

10. The method of claim 8, wherein the water soluble quenching oil comprises polyvinylpyrrolidones.

11. The method of claim 8, wherein the water soluble quenching oil comprises sodium polyacrylates.

12. The method of claim 8, wherein the water soluble quenching oil comprises sodium polyisobutylenemaleates.

13. The method of claim 8, wherein the water soluble quenching oil comprises polyethylene glycols.

14. The quenching method of claim 1, which is carried out while the coolant is stirred.

* * * * *